US006330208B1

(12) United States Patent
Chen et al.

(10) Patent No.: US 6,330,208 B1
(45) Date of Patent: Dec. 11, 2001

(54) WATCH WITH FRONT MOUNTED LIQUID CRYSTAL DISPLAY AND LIQUID CRYSTAL DISPLAY WITH REFLECTIVE SHEET

(75) Inventors: Leo Chen, Kowloon (HK); Tadashi Sode, Nagano-Pref (JP)

(73) Assignee: Xonix Watch Co., Ltd., Hong Kong (HK)

( * ) Notice: Subject to any disclaimer, the term of this patent is extended or adjusted under 35 U.S.C. 154(b) by 0 days.

(21) Appl. No.: 09/174,265

(22) Filed: Oct. 16, 1998

(51) Int. Cl.[7] ..... G04C 19/00; G04B 37/00; A44C 5/00

(52) U.S. Cl. ..... 368/84; 368/88; 368/281; 368/299; 368/309

(58) Field of Search ..... 368/82, 84, 88, 368/223, 276, 281, 294–296, 299, 300, 309, 239, 242

(56) References Cited

U.S. PATENT DOCUMENTS

| | | | | |
|---|---|---|---|---|
| 3,759,031 | | 9/1973 | McCullough et al. . | |
| 3,945,195 | | 3/1976 | Mason . | |
| 3,973,835 | | 8/1976 | Miyakawa et al. . | |
| 4,144,705 | * | 3/1979 | Iinuma | 368/88 |
| 4,194,351 | * | 3/1980 | Kume et al. | 368/82 |
| 4,198,811 | * | 4/1980 | Ratajski | 368/292 |
| 4,232,512 | * | 11/1980 | Yoshikawa et al. | 368/82 |
| 4,272,838 | * | 6/1981 | Kasama | 368/88 |
| 4,276,627 | * | 6/1981 | Komiyama | 368/86 |
| 5,008,869 | | 4/1991 | Dweck . | |
| 5,224,078 | | 6/1993 | Mallin . | |
| 5,566,137 | | 10/1996 | Chevroulet et al. . | |

FOREIGN PATENT DOCUMENTS

WO97/01788 * 1/1997 (WO) .

OTHER PUBLICATIONS

Break Gear vol. 9, Sep. 1997, various pages including p. 15, which Applicants believe discloses a conventional accommodation made in the area of liquid crystal display known as corner cutting.

* cited by examiner

*Primary Examiner*—Vit Miska
(74) *Attorney, Agent, or Firm*—Dinsmore & Shohl LLP

(57) ABSTRACT

A watch with a liquid crystal display with the display and the device for controlling the display being formed as two separate pieces so that the display can be inserted through a front side of the watch case body and the control device, such as a printed circuit board, can be inserted through a back side of the watch case body. The liquid crystal display may include a partially reflective sheet in order to provide greater contrast and/or aesthetic appeal. Also, a method for assembling a watch wherein a liquid crystal display is inserted through the front side of the watch case body. This watch and related assembly method can allow a larger size display relative to the size of the watch case body.

27 Claims, 3 Drawing Sheets

WATCH WITH FRONT MOUNTED LIQUID CRYSTAL DISPLAY AND LIQUID CRYSTAL DISPLAY WITH REFLECTIVE SHEET

FIELD OF THE INVENTION

The present invention is directed to a watch, such a watch for display of the time, a stopwatch, a calculator watch, a video game in the form of a watch or the like. The present invention is more particularly directed to a watch having a liquid crystal display.

BACKGROUND OF THE INVENTION

As shown in FIG. 1, a conventional liquid crystal display watch 1 includes a case body 10, a transparent case front 12, a module 14 and a case back 16. The module 14 is an integral unit which includes a battery (not separately shown) for power, a printed circuit board (not separately shown) to control a display and a liquid crystal display 15.

There is an ongoing need for liquid crystal displays 15 which are easier to read and aesthetically pleasing. Some convention liquid crystal displays can be difficult to read because of their small size. Some conventional liquid crystal displays can be difficult to read because of a relatively low degree of contrast between the liquid crystal display characters and the background.

FIG. 2 shows a cross-section of the case body 10. The peripheral wall 18 of the case body 10 is relatively thick, in order to provide sufficient strength and rigidity, and also to allow a tight connection (such as a sealed watertight gasket) to the case back 16. Furthermore, the thick peripheral wall 18 can help to support button structures (not shown) which are disposed through the peripheral wall.

Conventionally, watches, such as watch 1, are constructed by performing the following steps in the following order: (1) the transparent case front 12 is sealed to the case body 14, (2) the module 16 is inserted in the opening 20 in the back (non-viewing) side of the case body, and (3) the case back 16 is sealed over the opening 20.

The area of the liquid crystal display is limited by the size of the opening 20. More specifically, because the peripheral wall 18 is thick, the opening 20 and the liquid crystal display 15 disposed within the opening 20 are substantially smaller then the profile of the case body 10. Of course, the smaller the display 15, the more difficult it is to read. Also, smaller displays 15 may be considered less aesthetically pleasing.

Corner cutting is one conventional accommodation made in order to provide a larger display relative to the outer profile of case body. In a corner cut watch, the corners of the opening in the case body and the module are chamfered. One drawback of corner cut watches is that the chamfered case body and module are generally more expensive to produce.

SUMMARY OF THE INVENTION

It is an object of some embodiments of the present invention to provide a liquid crystal display watch, and a method for making the same, which has a relatively large liquid crystal display relative to the size of the watch case. It is a further object of some embodiments of the present invention to provide a liquid crystal display watch, and a method for assembling the same, which has good strength and rigidity. It is a further object of some embodiments of the present invention to provide a liquid crystal display watch, and method of making the same, which has sufficient thickness in the peripheral wall of its case to allow a tight connection between the case body and the case back. It is a further object of some embodiments of the present invention to provide a liquid crystal display watch, which has sufficient thickness in the peripheral wall of its case to support user input devices as buttons, keys, or rotary dials. It is a further object of some embodiments of the present invention to provide a liquid crystal display which has a relatively large display without resorting to corner cutting.

At least some of the foregoing objectives may be achieved by utilizing a case body with a peripheral wall which is thicker toward the back side and thinner toward the front side, and by mounting the liquid crystal display through the front of the case body, rather than through the back.

It is a further object of some embodiments of the present invention to provide a liquid crystal display which includes a reflective sheet. It is a further object of some embodiments of the present invention to provide a liquid crystal display which is aesthetically pleasing and has a high degree of contrast between the characters and the background of the display.

Still other objects of the present invention will become readily apparent to those skilled in this art from the following description wherein there is shown and described a preferred embodiment of this invention, simply by way of illustration, of one of the best modes contemplated for carrying out this invention. As will be realized, the invention is capable of other different embodiments, and its several details are capable of modification in various aspects all without departing from the invention. Accordingly, the drawings and descriptions will be regarded as illustrative in nature and not as restrictive.

According to some embodiments of the present invention, the present invention, a watch includes a case body, a liquid crystal display. The case body has a front side, a back side and a peripheral wall extending from the front side to the back side. The peripheral wall includes a front side portion in the vicinity of the front side and a back side portion in the vicinity of the back side. The thickness of the front side portion of the peripheral wall is less than the thickness of the back side portion of the peripheral wall.

The liquid crystal display is disposed at least partially within the case body in the vicinity of the front side portion of the peripheral wall. The control device controls the liquid crystal display, and the control device is at least partially disposed in the vicinity of the back side portion of the peripheral wall. In this way, the peripheral wall can accommodate a relatively large liquid crystal display while providing sufficient protection and support for the control device and related buttons or watertight gaskets.

According to some embodiments of the present invention, a liquid crystal display includes a liquid crystal state material layer, a back light, and a partially reflective material layer located between the liquid crystal state material layer and the back light. The partially reflective material layer will allow some of the light emitted from the back light to pass therethrough to illuminate the liquid crystal state material layer, while reflecting much of the ambient light which passes through the liquid crystal state material layer. In this way, the partially reflective material layer can help enhance contrast and/or aesthetic appeal of the liquid crystal display.

BRIEF DESCRIPTION OF THE DRAWINGS

The present invention as set forth in the detailed description will be more fully understood when viewed in connection with the drawings in which.

DETAILED DESCRIPTION

Figure 1:
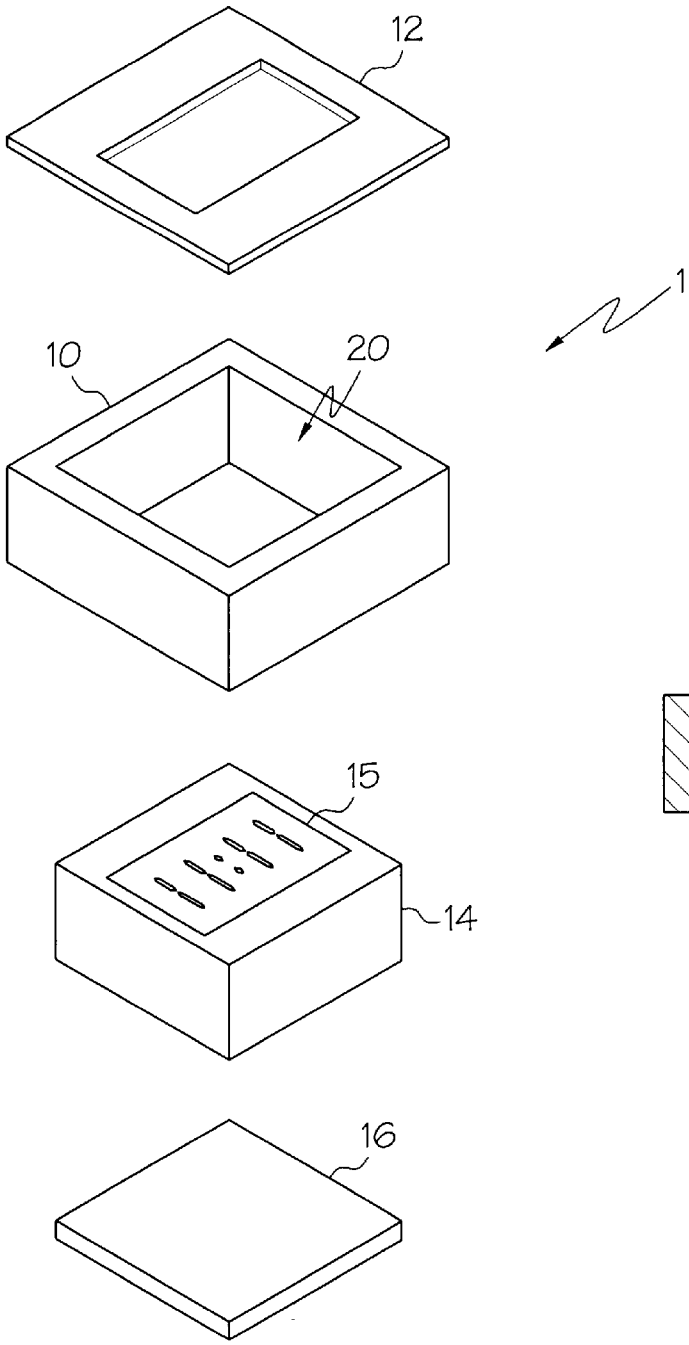
FIG. 1 (PRIOR ART)
FIG. 1 is an exploded perspective view of a conventional liquid crystal display watch.
Figure 2:
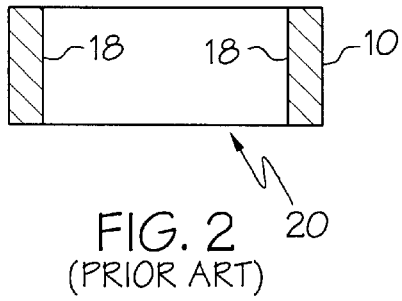
FIG. 2 (PRIOR ART)
FIG. 2 is a cross-sectional view of a conventional liquid crystal display watch case.
Figure 3:
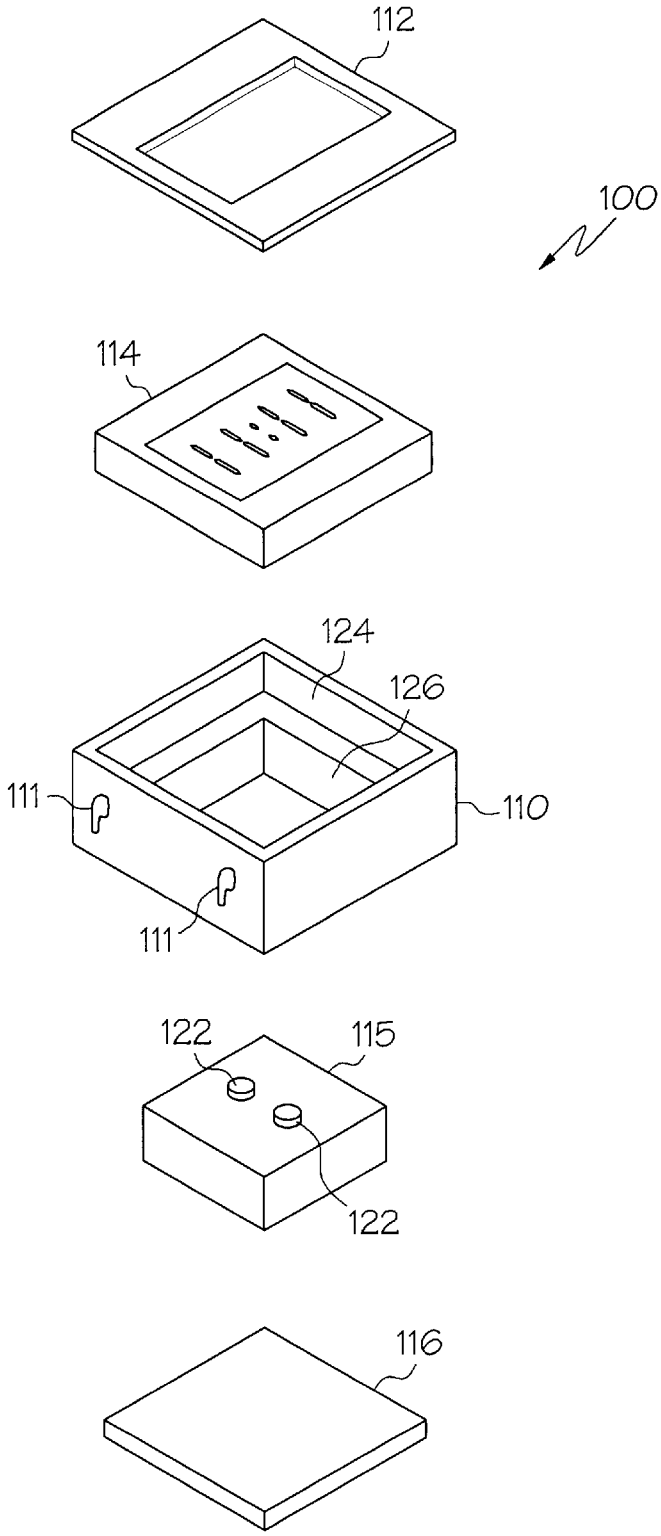
FIG. 3 is an exploded perspective view of a first embodiment of a liquid crystal display watch according to the present invention.
Figure 4:
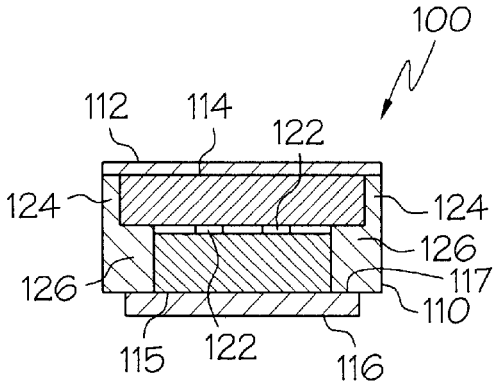
FIG. 4 is a cross-sectional view of the first embodiment of a liquid crystal display watch according to the present invention.

Referring now to the drawings in detail, wherein like numerals indicate the same elements throughout the Figures, a preferred embodiment of a watch 100 according to the present invention will be explained with reference to FIGS. 3 and 4. Watch 100 includes watch case body 110, case front 112, liquid crystal display 114, printed circuit board (PCB) control device 115, and case back 116. As shown in FIG. 4, the liquid crystal display 114 is disposed within the watch case body 110 toward the front (viewing) side of the watch 100. The PCB control device is disposed within the case body 110 toward the back side of the watch 100. The case front is disposed over the opening at the front side of the case body 110. The case back 116 is disposed over the opening of the back side of the watch case body 110.

The watch case 110 serves to protect, support and constrain the liquid crystal display 114 and the PCB control device 115. While watch case 110 has a generally square profile, it is possible to use other shapes for the casing. Watch case 110 includes a thin peripheral wall portion 124 and a thick peripheral wall portion 126. Although the preferred watch case 110 is shown as a single integral piece, the watch case 110 may alternatively be formed by two or more pieces, such as a thin wall piece and a thick wall piece, which are connected by screws, adhesive or other conventional means to form the watch case. Watch case 110 also includes watch band attachment elements 111 for attaching a wrist watch band to the watch.

The thin peripheral portion 124 is located toward the front side of watch 100, i.e. the side from which a viewer would view the display shown on the watch. The thick peripheral wall portion 126 is located toward the back side of the watch, which is opposite the front side. As shown in FIG. 4, the liquid crystal display 114 is sized and shaped to fit within the watch case 110 where the peripheral wall 124 is thin.

Because the peripheral wall 124 is thin, the liquid crystal display 114 can be made larger with respect to the outside profile of the watch case 110. This larger liquid crystal display is easier to read and is also aesthetically appealing. The liquid crystal display 114 is preferably held down by a metal contact (not shown) which is screwed to the case body 110.

On the other hand, the PCB control device 115 is sized and shaped to fit within watch case 110 where the peripheral wall 126 is thick. Preferably, the PCB control device is screwed to the case body from the back. The thick peripheral wall 126 which secures the PCB control device 115 serves to give the case sufficient strength and rigidity to withstand mechanical shocks. Also, as further explained below with reference to FIGS. 5 and 6, the thick peripheral wall portion 126 provides material sufficient to support a water tight seal with the case back 116 and to support button mechanisms or pusher assemblies and their related gaskets.

An exemplary method for assembling watch 100 will now be described. First, liquid crystal display 114 is front mounted through the opening in front of watch case 110 so that it is secured in the peripheral direction by peripheral wall portion 124.

Next, case front 112 is sealed by conventional methods on the front of watch case 110 over the front side opening of watch case 110 so that the liquid crystal display 114 is visible through transparent portions of the glass case front 112. Of course, case front 112 may be made of other transparent materials besides glass. It is noted that because the liquid crystal display 114 is large in relation to the size of watch case 110, the transparent portion of case front 112 needs to be made large enough to completely view the display.

Next, PCB control device 115 is inserted through the opening at the back of watch case 110. PCB control device 115 includes batteries (not separately shown), which provide power for the PCB control device 115 and liquid crystal display 114. The batteries will generally be detachable from the PCB control device 115 (similarly to the way detachable batteries form part of integral modules inside of a conventional liquid crystal display watches). Alternatively, the batteries may be formed as separate pieces.

PCB control device 115 is inserted so that contact pads 122 face the liquid crystal display 114 at the interior of watch case 110. As shown in FIG. 4, contact pads 122 contact the underside of the liquid crystal display 114 so that control signals can be communicated from the PCB control device 115 to the liquid crystal display 114. Structures (not shown) on the back side of the liquid crystal display 114 are adapted to contact the pads 122 and receive the control signals from the pads 122. These control signals control the liquid crystal display 114 to effect an appropriate display, such as a display of the time of day, date, a stop watch display, a video game display or the like.

Alternatively, in order to electrically connect the PCB control device 115 to the liquid crystal display 114, the case 110 may be provided with slots to allow insertion of a connector, such as a rubber connector, so that signals can be sent from the PCB control device 115 to the liquid crystal display 114. Finally, case back 116 is secured over the opening in the back side of the watch case 110 by screws, threads, pressure fitting, or other conventional means.

Of course, variations in the assembly method are possible. For example, the PCB control device 115, and even the case back 116, may be assembled to the watch case prior to insertion of the liquid crystal display 114. As another alternative, the PCB control device 115 may be inserted through the front of the watch case prior to insertion of the liquid crystal display 114.

Figure 5:
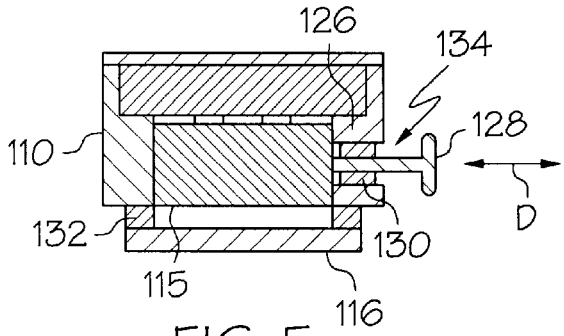
FIG. 5 is a cross-sectional view of the first embodiment of a- liquid crystal display watch, modified to include a button assembly.

FIG. 5 shows a modified embodiment of the watch 100 described in connection with FIGS. 3 and 4. More particularly, the watch shown in FIG. 5 additionally includes a button 128, button gasket 130 and case back gasket 132. Button (or pusher assembly) 128 can be moved through a stroke range in the direction of double arrow D shown in FIG. 5. The button 128 provides a simple user input to the PCB control device 115. This user input can be used by the PCB control device 115 to set the clock, start or stop a stop watch, switch between various types of display, or the like.

Although the embodiment shown in FIG. 5 includes only one button, many watches will include more than one button disposed at intervals around the watch case.

The button 128 extends through watch case 110 within aperture 134. In order to keep the watch case 110 watertight in the vicinity of aperture 134, button gasket 130 is employed. Although button gasket 130 is shown as a single piece extending around button 128, other conventional ways of effecting an appropriate water tight seals, such as the use of two or even three O-rings, may be employed. Because aperture 134 is disposed within the thick peripheral wall portion 126, there is sufficient room to secure gasket 130. The aperture 134 is in the thick peripheral wall portion 126 may also help accommodate other hardware related to user input devices, such as button biasing hardware.

Ring gasket 132 serves to make a watertight seal between case back 116 and watch case 110. Because the case back is sealed to the case over the back of the watch adjacent to thick peripheral wall portion 126, there is sufficient room to accommodate ring gasket 132 and thereby maintain a good watertight seal between the case back 116 and the watch case 110. As is readily apparent from the foregoing description, according to the present invention a watch case of the desired size can accommodate the gasket and seals associated with buttons and with the case back, while still allowing use of a regularly large liquid crystal display in the vicinity of the front of the watch where the peripheral wall of the watch case is thin.

Although the embodiment in FIG. 5 shows a button, other user input devices, such as rotary knobs, may also be used. It should be appreciated that the thick peripheral wall portion 126 will facilitate support and watertight sealing of many types of user input devices.

Figure 6:
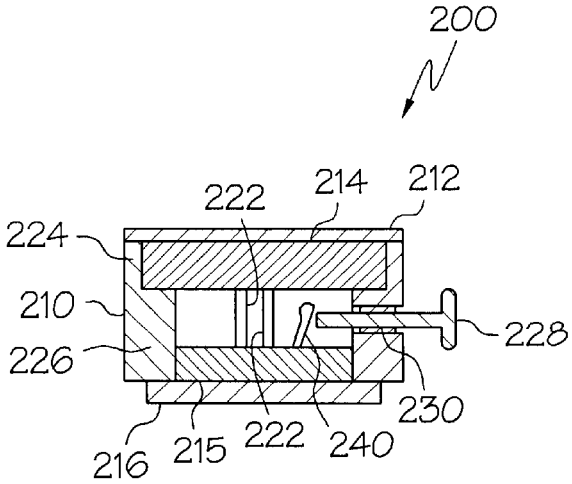
FIG. 6 is a cross-sectional view of a second embodiment of a liquid crystal display watch according to the present invention.

FIG. 6 shows another embodiment of a watch 200 according to the present invention. Watch case 210, case front 212, liquid crystal display 214, and case back 216 are constructed to be similar to the corresponding elements of the embodiment previously described in connection with FIGS. 3 and 4 and will not be further discussed here. However, in watch 200, the PCB control device 215 is spaced away from the liquid crystal display 214. This allows button 228 to freely move in the space between the liquid crystal display 214 and the PCB control device 215. Because button 228 travels within watch case 210 in the space between liquid crystal display 214 and PCB control device 215, neither the display 214 nor the PCB device 215 limits the stroke distance of button 228 and button 228 may therefore have a greater stroke distance. Button 228 is positioned to actuate a biased lever 240, thereby allowing a user input to the PCB control device 215 which is attached at the end of the biased lever 240. Of course, other conventional structures may be used in place of biased lever 240 to communicate the position of button 228 to the PCB control device 215. Display control signals are communicated from the PCB control device 215 to the liquid crystal display 214 by pins 222 which extend from the PCB control device 215 to the liquid crystal display 214.

Figure 7:
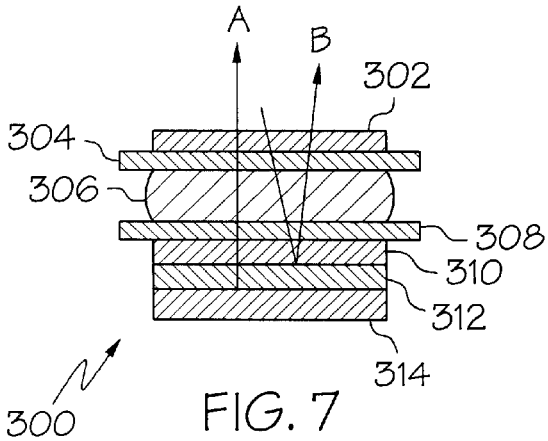
FIG. 7 is a cross-sectional view according to the present invention.

FIG. 7 shows a preferred embodiment of a liquid crystal display according to the present invention. Liquid crystal display 300 includes first polarizing layer 302, first transparent layer 304, liquid crystal state material layer 306, second transparent layer 308, second polarizing layer 310, partially reflective material 312 and back light 314.

The first and second transparent layers 304, 308 include electrodes which can be charged to control the optical properties of liquid crystal state material layer 306 disposed therebetween. By controlling the charge of the electrodes in first and second transparent layers 304, 308, the appearance of the liquid crystal display 300 is controlled. Because the optical polarity of the liquid crystal state material 306 is controlled by the first and second transparent layers 304, 308, polarizing layers 302, 310 are used in the conventional manner to help form and optimize the liquid crystal display.

As in conventional liquid crystal displays, a backlight 314, preferably formed as a light-emitting diode, sends light out through the partially reflective layers 312, the second polarizing layer 310, the second transparent layer 308, the liquid crystal state material layer 306, the first transparent layer 304, and the first transparent layer 302 as shown by arrow in order to illuminate and form a liquid crystal display image.

As in conventional liquid crystal displays, the liquid crystal state material 306 (as controlled by the first and second transparent layers 304, 308) and the first and second polarizing layers 302, 310 will allow light from the backlight 314 to pass through in certain areas while not in others, thereby forming the liquid crystal display image.

The partially reflective material layer 312 helps to enhance the aesthetic appeal and the contrast of the liquid crystal display. The partially reflective material layer 312 is constructed so that it will transmit a substantial percentage of visible light incident thereon and also reflect a substantial amount of visible light incident thereon. In this way, partially reflective material layer 312 acts like a one-way mirror. Preferably, partially reflective material layer 312 is formed by sputtering or spattering polyester with aluminum in a metal adhesion process carried out in a vacuum. The partially reflective material layer 312 may be relatively thin and flexible.

Because the partially reflective material layer 312 transmits some visible light and also reflects some visible light, the LCD background tends to appear to an observer as a mirrored surface, which provides a good contrast with the characters of the LCD display. As discussed above, some of the light from the back light will be transmitted through partially reflective material layer 312 as shown by arrow A. At the same time, some of the light from backlight 314 will also be reflective back toward backlight 314 and will not pass through the other layers into the outside. For this reason, it may be helpful to use a backlight 314 with a somewhat greater intensity than utilized in conventional liquid displays.

As shown by arrow B, some ambient light from the outside will be reflected from partially reflective material layer 312. This is what gives liquid crystal display 300 its mirror-like appearance. Of course, partially reflective material layer 312 will also transmit some ambient light therethrough and onto backlight 314.

Preferably the percentage of light reflected by partially reflective material layer 312 (i.e., the reflectance) is at least 50% in the visible light range. More preferably, the reflectance of partially reflective material layer 312 is in the range between 70% and 90%. Most preferably, the reflectance of partially reflected material layer 312 is approximately 80% (in which case the partially reflected material layer would reflect about 80% of incoming visible light while transmitting up to about 20% of incident visible light).

The foregoing examples and various preferred embodiments of the present invention set forth herein are provided for illustrative purposes only and are not intended to limit the scope of the invention defined by the claims. Additional embodiments of the present invention and advantages thereof will be apparent to one of ordinary skill in the art and are within the scope of the invention defined by the following claims.

What is claimed is:

1. A watch comprising:

a case body having a front side, a back side and a peripheral wall extending from the front side to the back side, the peripheral wall comprising a front side portion having a front side thickness in the vicinity of the front side and a back side portion having a back side thickness in the vicinity of the back side, said back side thickness being greater than said front side thickness;

a liquid crystal display disposed at least partially within a first opening defined by the front side portion of the peripheral wall, said first opening occupying substantially the entire surface of the front side of the case body; and a control device structured to control the liquid crystal display, the control device being disposed in a second opening defined by the back side portion of the peripheral wall and adjacent to said peripheral wall having the back side thickness.

2. The watch according to claim 1, wherein the control device is not formed integrally with the liquid crystal display.

3. The watch according to claim 1, further comprising at least one user input device disposed at least partially within the back side portion of the peripheral wall.

4. The watch according to claim 3, further comprising a watertight gasket element disposed around the at least one user input device.

5. The watch according to claim 3, wherein the at least one user input device comprises a button.

6. The watch according to claim 5, wherein the button is disposed away from the liquid crystal display so that the liquid crystal display does not limit a stroke distance of the button.

7. The watch according to claim 1, further comprising a case front disposed over the front side of the case body.

8. The watch according to claim 1, further comprising a case back disposed over the back side of the case body.

9. The watch according to claim 1, wherein:

the control device has a control device area measured in a plane parallel to the back side of the case body;

the liquid crystal display has a display area measured in a plane parallel to the back side of the case body; and the display area is greater than the control device area.

10. The watch according to claim 1, wherein the control device comprises a printed circuit board.

11. The watch according to claim 1, wherein the front side portion has a front side thickness and the back side portion has a back side thickness, the back side thickness being greater than the front side thickness.

12. The watch according to claim 1, wherein said backside portion of said peripheral wall also defines an opening which is smaller than said liquid crystal display.

13. A watch comprising:

a liquid crystal display;

a control device structured to control the liquid crystal display and not being integrally formed with the liquid crystal display;

a case body having a front side, a back side and a peripheral wall extending from the front side to the back side, the peripheral wall having a front side thickness in the vicinity of the front side and a back side thickness in the vicinity of the back side; said back side thickness being greater than said front side thickness;

the liquid crystal display being disposed within the case body adjacent said front side thickness; and the control device being disposed within an opening of the case body adjacent said back side thickness.

14. The watch according to claim 13, further comprising at least one user input device disposed at least partially within an aperture in a portion of the peripheral wall having the back side thickness.

15. The watch according to claim 14, wherein at least one user input device is disposed away from the liquid crystal display so that the liquid crystal display does not limit a stroke distance of the at least one button.

16. The watch according to claim 13, further comprising a case front disposed over the front side of the case body.

17. The watch according to claim 13, further comprising a case back disposed over the back side of the case body.

18. The watch according to claim 13, wherein:

the control device has a control device area measured in plane parallel to the back side of the case body;

the liquid crystal display has a display area measured in a plane parallel to the back side of the case body; and the display area is greater than the control device area.

19. The watch according to claim 13, wherein the liquid crystal display further comprises:

a liquid crystal state material layer;

a back light; and a partially reflective material layer disposed between the liquid crystal state material layer and the back light.

20. The liquid crystal display according to claim 19, wherein the partially reflective material layer reflects at least 50% of incident visible light.

21. The liquid crystal display according to claim 19, wherein the partially reflective material layer reflects between 70% and 90% of incident visible light.

22. The liquid crystal display according to claim 19, further comprising:

a first transparent layer with at least one electrode; and a second transparent layer with at least one electrode, so that the liquid crystal state material layer is disposed between the first transparent layer and the second transparent layer and the partially reflective material layer is disposed between the second transparent layer and the back light.

23. The liquid crystal display according to claim 22 further comprising:

a first polarizing layer; and a second polarizing layer;

wherein the first transparent layer is disposed between the first polarizing layer and the liquid crystal state material layer; and wherein the second polarizing layer is located between the liquid crystal state material and the partially reflective material layer.

24. A method of assembling a watch comprising the steps of:

providing a case body having a front side with a front side opening, a back side with a back side opening and a peripheral wall extending from the front side to the back side;

inserting a liquid crystal display into the case body through the front side opening; and inserting a control device for controlling the liquid crystal display through the back side opening.

25. The method according to claim 24, wherein the liquid crystal display is inserted before the control device is inserted.

26. The method according to claim 24, further comprising the step of sealing a case front over the front side opening.

27. The method according to claim 26, wherein the case front is sealed after the liquid crystal display is inserted, and before the control device is inserted.

* * * * *